US008359817B2

(12) United States Patent
Tai et al.

(10) Patent No.: US 8,359,817 B2
(45) Date of Patent: Jan. 29, 2013

(54) FACE MASK COMBINATION AND AUTOMATIC PACKAGING METHOD FOR FACE MASKS

(75) Inventors: Jung-Chi Tai, Tainan Hsien (TW); Ho-Hsi Yang, Tainana Hsien (TW); Chien-Chung Su, Tainan Hsien (TW)

(73) Assignee: Kang Na Hsiung Enterprise Co., Ltd., Tainan Hsien (TW)

( * ) Notice: Subject to any disclaimer, the term of this patent is extended or adjusted under 35 U.S.C. 154(b) by 279 days.

(21) Appl. No.: 12/816,012

(22) Filed: Jun. 15, 2010

(65) Prior Publication Data

US 2011/0192888 A1 Aug. 11, 2011

(30) Foreign Application Priority Data

Feb. 11, 2010 (TW) ..... 99104386 A

(51) Int. Cl.
*B65D 85/18* (2006.01)

(52) U.S. Cl. ..... 53/447; 53/452; 206/581

(58) Field of Classification Search ..... 53/450, 53/452, 455, 456, 461, 463, 460, 443, 447, 53/389.2, 389.3; 206/278, 581, 38, 223
See application file for complete search history.

(56) References Cited

U.S. PATENT DOCUMENTS

| | | | | |
|---|---|---|---|---|
| 2003/0233813 | A1 * | 12/2003 | Leslie et al. | 53/412 |
| 2007/0062843 | A1 * | 3/2007 | Rudd | 206/581 |
| 2008/0072248 | A1 * | 3/2008 | Sosalla et al. | 725/34 |
| 2009/0205666 | A1 * | 8/2009 | Bowen | 128/206.13 |

* cited by examiner

*Primary Examiner* — Jacob K Ackun
(74) *Attorney, Agent, or Firm* — Holland & Hart LLP

(57) ABSTRACT

A face mask combination includes: an envelope having two interconnected sheet layers that confine a space therebetween, an opening formed in one of the sheet layers, and a closure sheet closing openably the opening and attached adhesively and releasably to the sheet layer formed with the opening; and at least one face mask disposed in the space and having two opposite ends, one of the opposite ends being disposed in proximity to the opening so as to be exposed from the opening when the closure sheet is opened. An automatic packaging method for face masks is also disclosed.

6 Claims, 8 Drawing Sheets

FACE MASK COMBINATION AND AUTOMATIC PACKAGING METHOD FOR FACE MASKS

CROSS-REFERENCE TO RELATED APPLICATION

This application claims priority of Taiwanese application no. 099104386, filed on Feb. 11, 2010.

BACKGROUND OF THE INVENTION

1. Field of the Invention

This invention relates to a face mask combination, more particularly to a face mask combination that can be made by an automatic packaging method and the packaging method used therefor.

2. Description of the Related Art

Referring to FIG. 1, a conventional face mask combination 9 includes an envelope 91 and a plurality of face masks 92 disposed in the envelope 91. The envelope 91 has upper and lower sheet layers 911, 912 that are interconnected with each other along three closed peripheral sides of the envelope 91 and that define together an opening 913 at an open peripheral side of the envelope 91, and an extension portion 914 extending from the lower sheet layer 912 at the open peripheral side. The extension portion 914 is adjacent to the opening 913 and is provided with an adhesive layer 915 thereon. The extension portion 914 can be folded to overlie on the upper sheet layer 911 and releasably close the opening 913 using the adhesive layer 915. Accordingly, when the extension portion 914 is released from the upper sheet layer 911, a required amount of the face masks 92 can be taken out from the opening 913, and thereafter, the extension portion 914 can be re-attached to the upper sheet layer 911 to close the opening 913. Hence, the remaining face masks 92 can be contained in the envelope 91 and be prevented from being contaminated.

In this case, since the opening 913 is formed at the open peripheral side of the envelope 91 and is closed by folding and attaching the extension portion 914 to the upper sheet layer 911, when making such face mask combination 9, the face masks 92 are first placed into the envelope 91 that was prepared in advance, a release film (not shown) is removed from the adhesive layer 915, and finally, the extension portion 914 is folded to be attached to the upper sheet layer 911 to close the opening 913. However, the above steps for making the face mask combination 9 are conducted manually. Thus, the method for making the face mask combination 9 has a relatively high cost and is time-consuming.

On the other hand, another conventional face mask combination made by an automatic packaging method is also available in the market. Although, in this case, the face mask combination can be produced at a relatively high speed, the envelope is in a sealed state, and the only way to take out the face mask is to tear open the envelope. Therefore, the face masks left in the envelope cannot be well-protected by the envelope and are likely to be exposed to and contaminated by the outside environment.

SUMMARY OF THE INVENTION

Therefore, an object of the present invention is to provide a face mask combination that can be made by an automatic packaging method, and that is formed with an opening which can be closed by a releasable closure sheet.

According to one aspect of this invention, a face mask combination is provided. The face mask combination comprises:

an envelope having two interconnected sheet layers that confine a space therebetween, an opening formed in one of the sheet layers, and a closure sheet closing openably the opening and attached adhesively and releasably to said one of the sheet layers; and at least one face mask disposed in the space and having two opposite ends, one of the opposite ends being disposed in proximity to the opening so as to be exposed from the opening when the closure sheet is opened.

According to another aspect of this invention, an automatic packaging method for face masks is provided. The method comprises:

advancing continuously an enveloping material;

forming a plurality of openings at intervals in the enveloping material;

attaching adhesively a plurality of closure sheets to the enveloping material with each of the closure sheets closing one of the openings;

placing the face masks on the enveloping material at intervals and aligning one end of each of the face masks with one of the openings; and forming the enveloping material into a plurality of envelopes so that each of the envelopes encloses at least one of the face masks.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
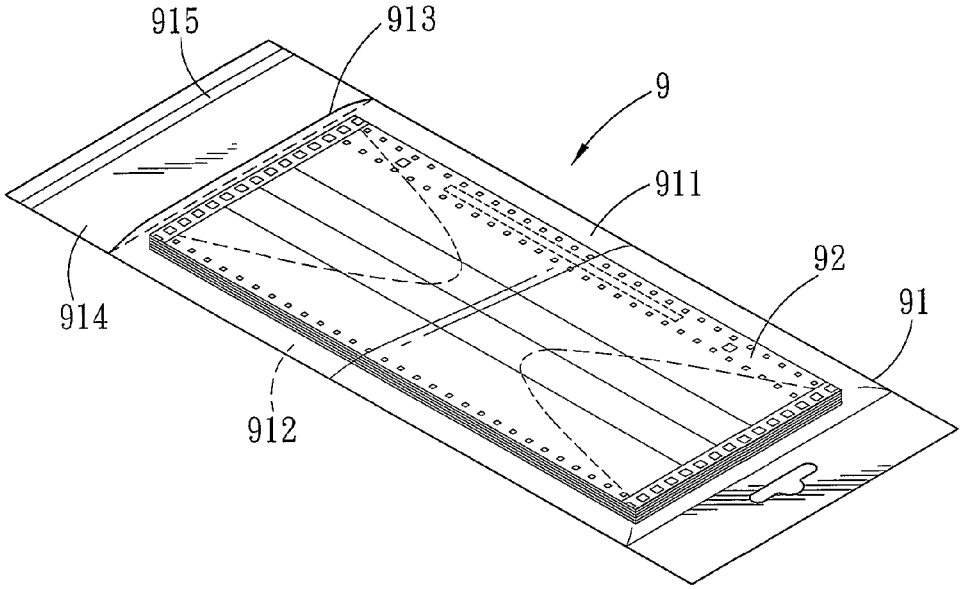
FIG. 1 PRIOR ART
FIG. 1 is a schematic view illustrating a conventional face mask combination.

Before the present invention is described in greater detail with reference to the accompanying preferred embodiments, it should be noted herein that like elements are denoted by the same reference numerals throughout the disclosure.

Figure 2:
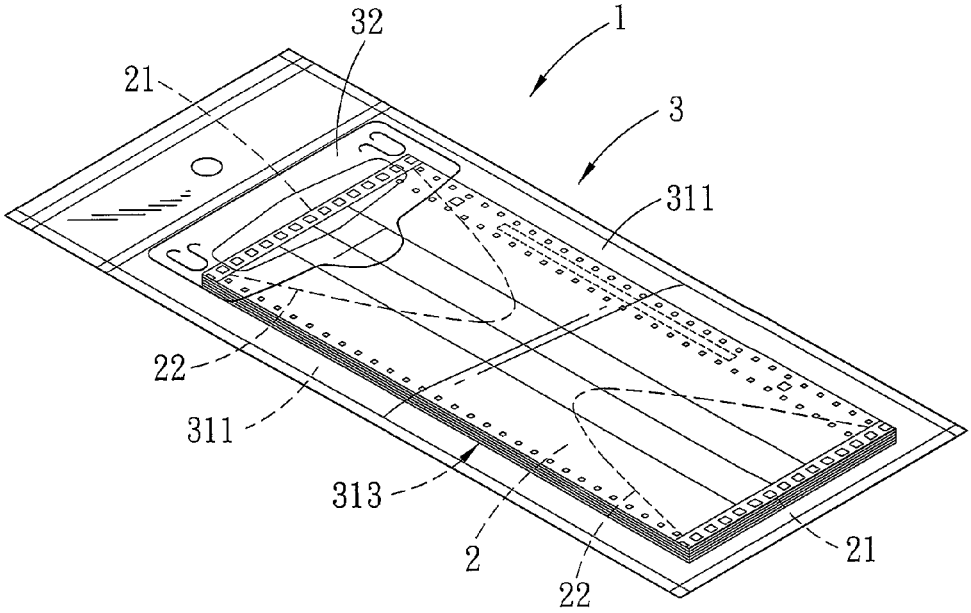
FIG. 2 is a schematic view illustrating the preferred embodiment of a face mask combination with a closed opening according to the present invention.
Figure 3:
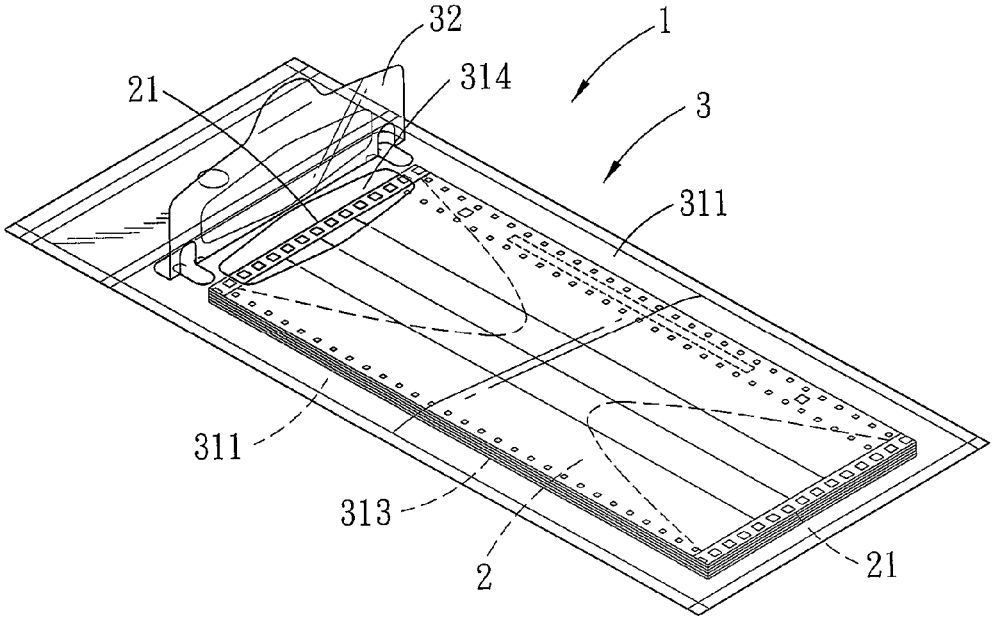
FIG. 3 is the same view as FIG. 2 but illustrating a state in which an end of a closure sheet used for closing the opening is removed to expose the opening.

Referring to FIGS. 2 and 3, a face mask combination 1 according to the preferred embodiment of the present invention includes a plurality of face masks 2 and an envelope 3. The envelope 3 has two interconnected sheet layers 311, an opening 314 formed in one of the sheet layers 311, and a closure sheet 32. The two interconnected sheet layers 311 confine a space 313 therebetween. The opening 314 is large enough for passage of at least one of the face masks 2. The closure sheet 32 closes openably the opening 314 and is attached adhesively and releasably to the sheet layer 311 formed with the opening 314. The face masks 2 are contained in the envelope 3 and are disposed in the space 313. Of course, it is also practicable that only one face mask 2 is contained in the envelope 3. Furthermore, the face masks 2 have two opposite ends 21, one of which is disposed in proximity to the opening 314. Accordingly, at least one of the face masks 2 can be exposed from the opening 314 when the closure sheet 32 is opened. Therefore, the face masks 2 can be taken out of the envelope 3 from the opening 314 after releasing the closure sheet 32 from said one of the sheet layers 311. After the required number of the face masks 2 is taken out, the remaining face mask(s) 2, if any, can be contained in the envelope 3 by re-attaching the closure sheet 32 to said one of the sheet layers 311, so as to prevent the face mask (s) 2 from being contaminated by the outside environment. In this embodiment, each of the face masks 2 is flat and has two ear loops 22 disposed respectively at the opposite ends 21.

Figure 4:
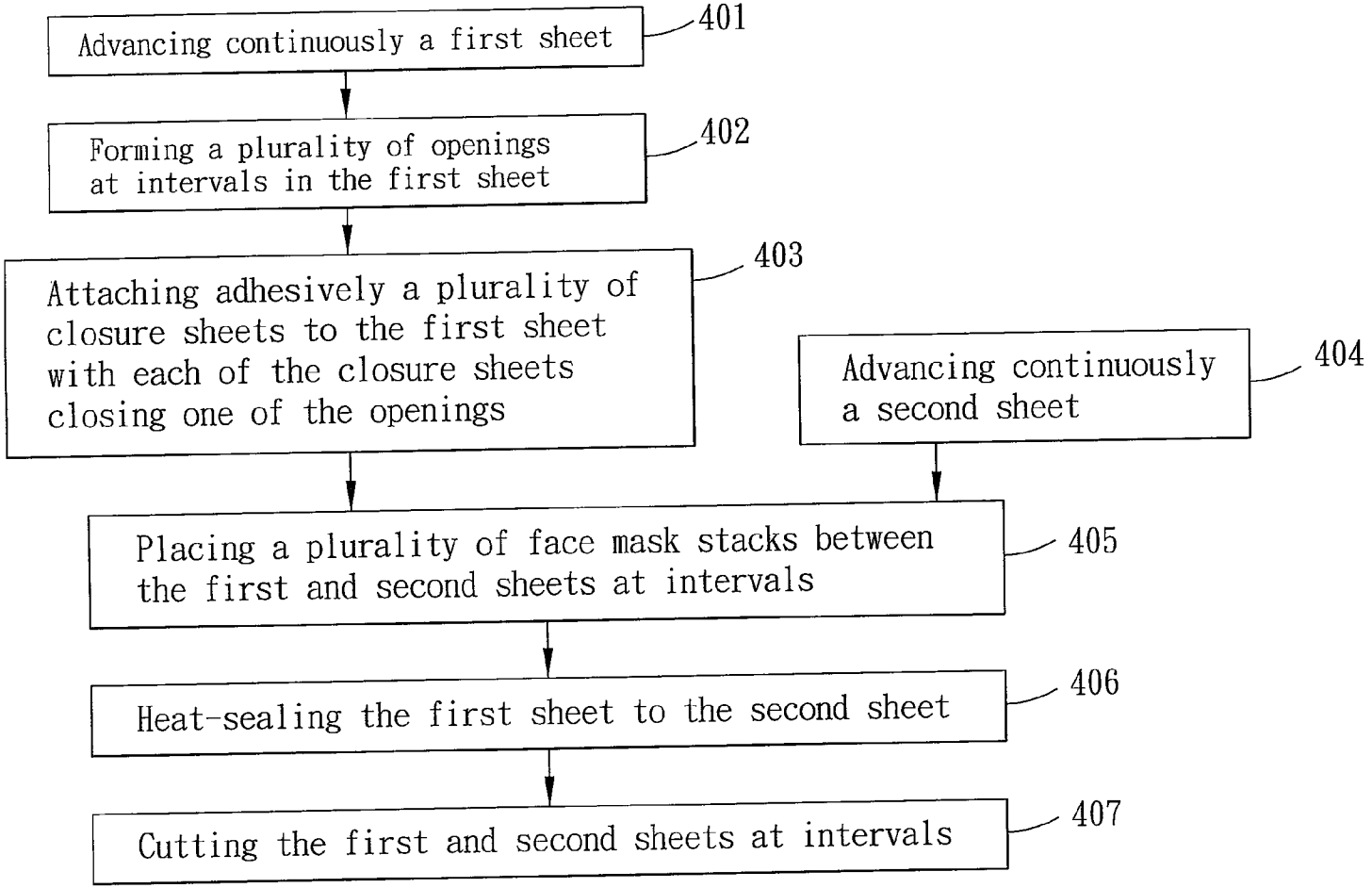
FIG. 4 is a flow chart showing an automatic packaging method for face masks according to the first preferred embodiment of the present invention.

FIG. 4 is a flow chart showing an automatic packaging method for face masks 2 according to the first preferred embodiment of the present invention.

For forming the envelope 3 of the face mask combination 1 according to the present invention, an enveloping material having first and second sheets 4 and 5 (see FIG. 6) is used in the method of the first preferred embodiment of this invention.

Figure 5:
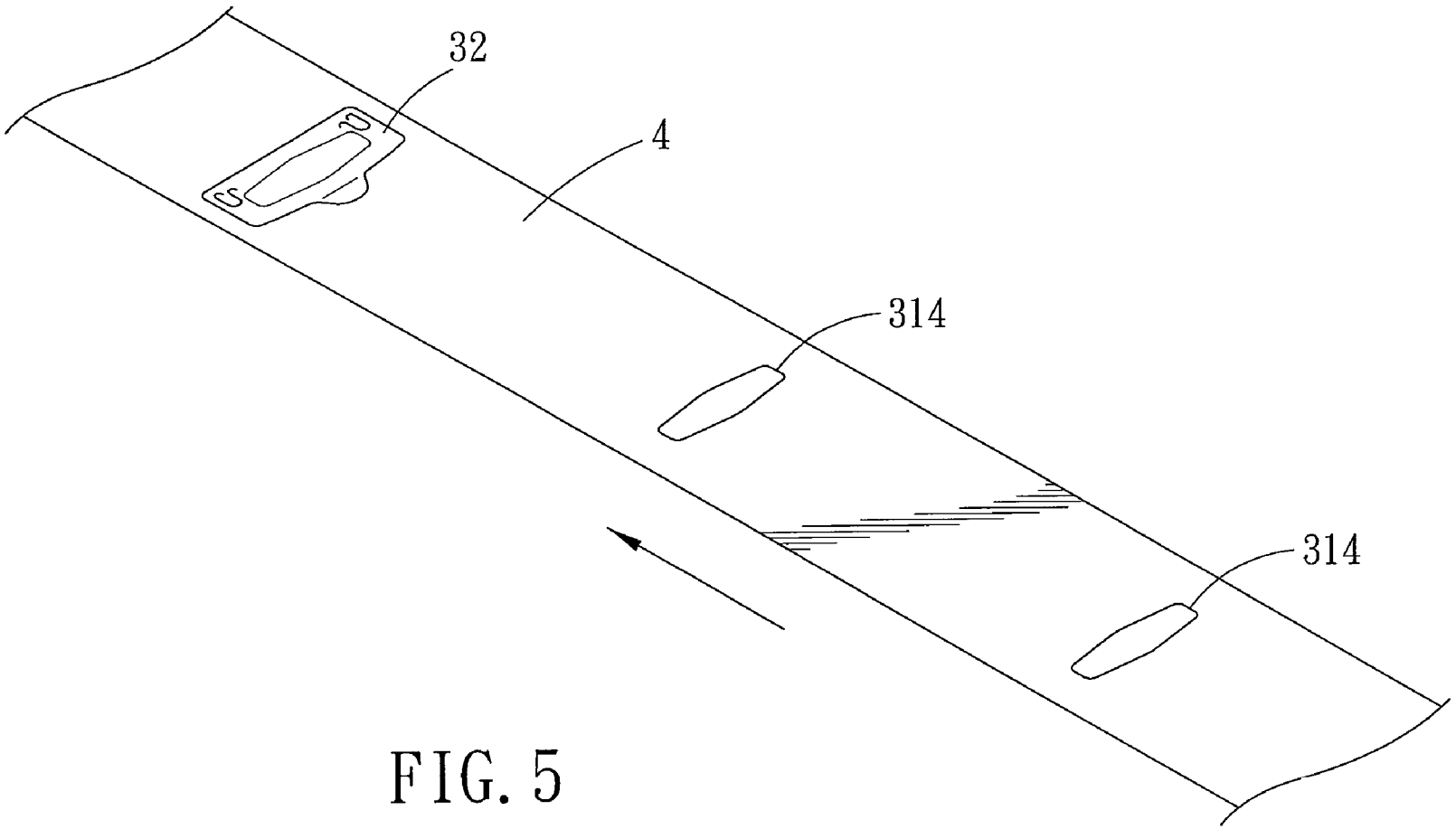
FIG. 5 is a schematic view illustrating a step of forming a plurality of openings and a step of attaching adhesively a closure sheet to close one of the openings according to the first preferred embodiment of the present invention.
Figure 6:
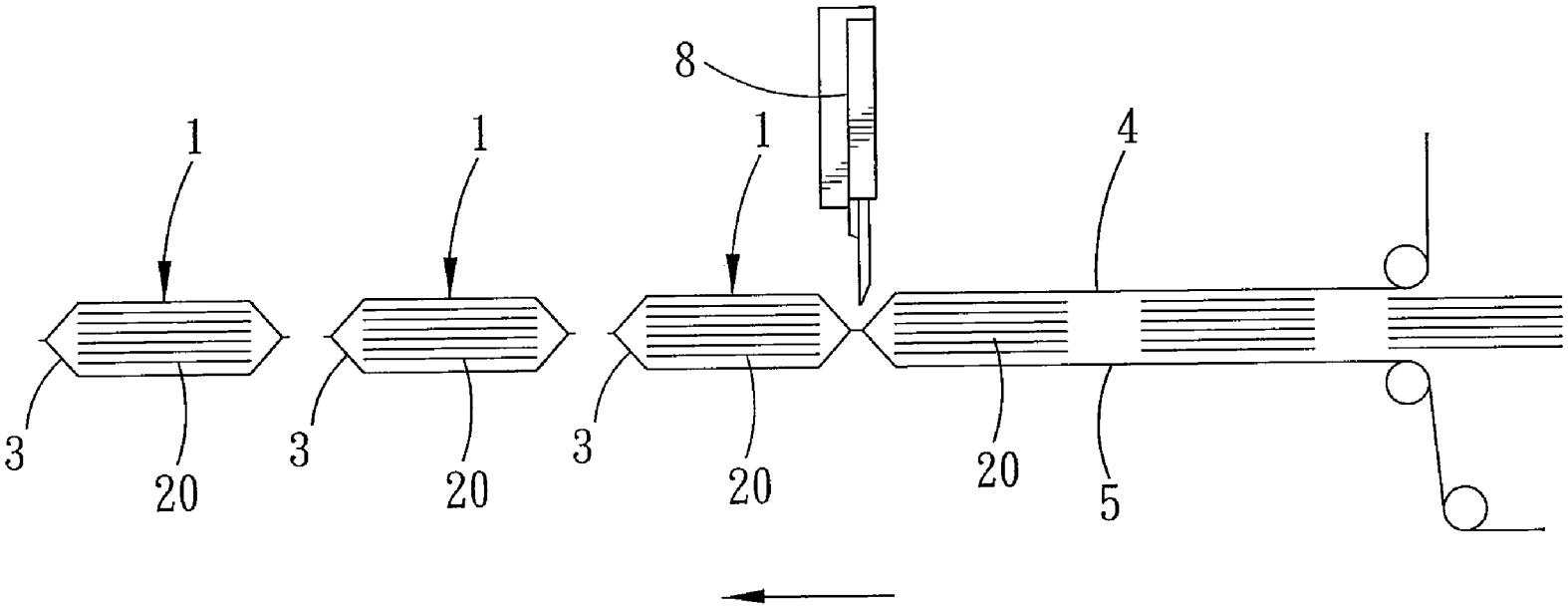
FIG. 6 is a schematic view illustrating how an enveloping material is advanced to package the face masks and is formed into envelopes enclosing the face masks.

In step 401, the first sheet 4 is advanced continuously on a conveyor (not shown) along a direction of an arrow shown in FIGS. 5 and 6. In step 402, a plurality of openings 314 are formed in the first sheet 4 at intervals, when the first sheet 4 passes through a punching device (not shown). In step 403, a plurality of closure sheets 32 (only one shown in FIG. 5) are attached adhesively to the first sheet 4, and each of the closure sheets 32 closes one of the openings 314.

In step 404, the second sheet 5 is advanced continuously. Particularly, the enveloping material is advanced by arranging the first and second sheets 4 and 5 one above the other, and advancing the first and second sheets 4 and 5 simultaneously (see FIG. 6). In the first preferred embodiment, the first and second sheets 4 and 5 are made of a plastic material.

In step 405, a plurality of face mask stacks 20 are placed between the first and second sheets 4 and 5 at intervals by a conveyor (not shown) so that one end of one of the face mask stacks 20 is aligned with one of the openings 314 and the closure sheet 32 closing said one of the openings 314. Each of the face mask stacks 20 includes at least one face mask 2 as shown in FIGS. 2 and 3.

In step 406, the first sheet 4 is heat-sealed to the second sheet 5 around four peripheral edges for each of the face mask stacks 20. In step 407, the heat-sealed first and second sheets 4 and 5 are cut at intervals using a cutter 8 (see FIG. 6) to form a plurality of envelopes 3 each having one of the face mask stacks 20 therein.

Figure 7:
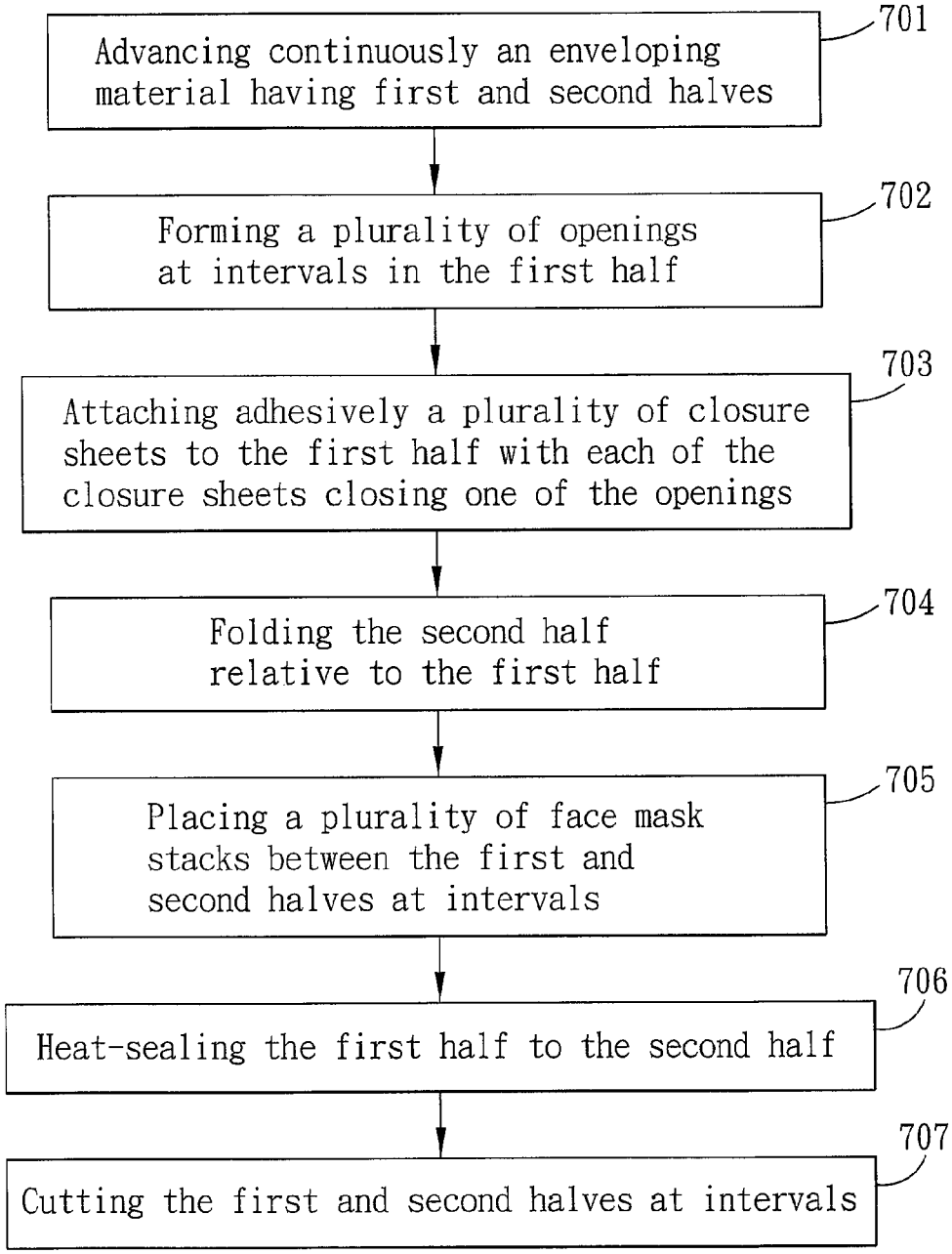
FIG. 7 is a flow chart showing an automatic packaging method for face masks according to the second preferred embodiment of the present invention.

FIG. 7 is a flow chart showing an automatic packaging method for face masks 2 according to the second preferred embodiment of the present invention.

Figure 8:
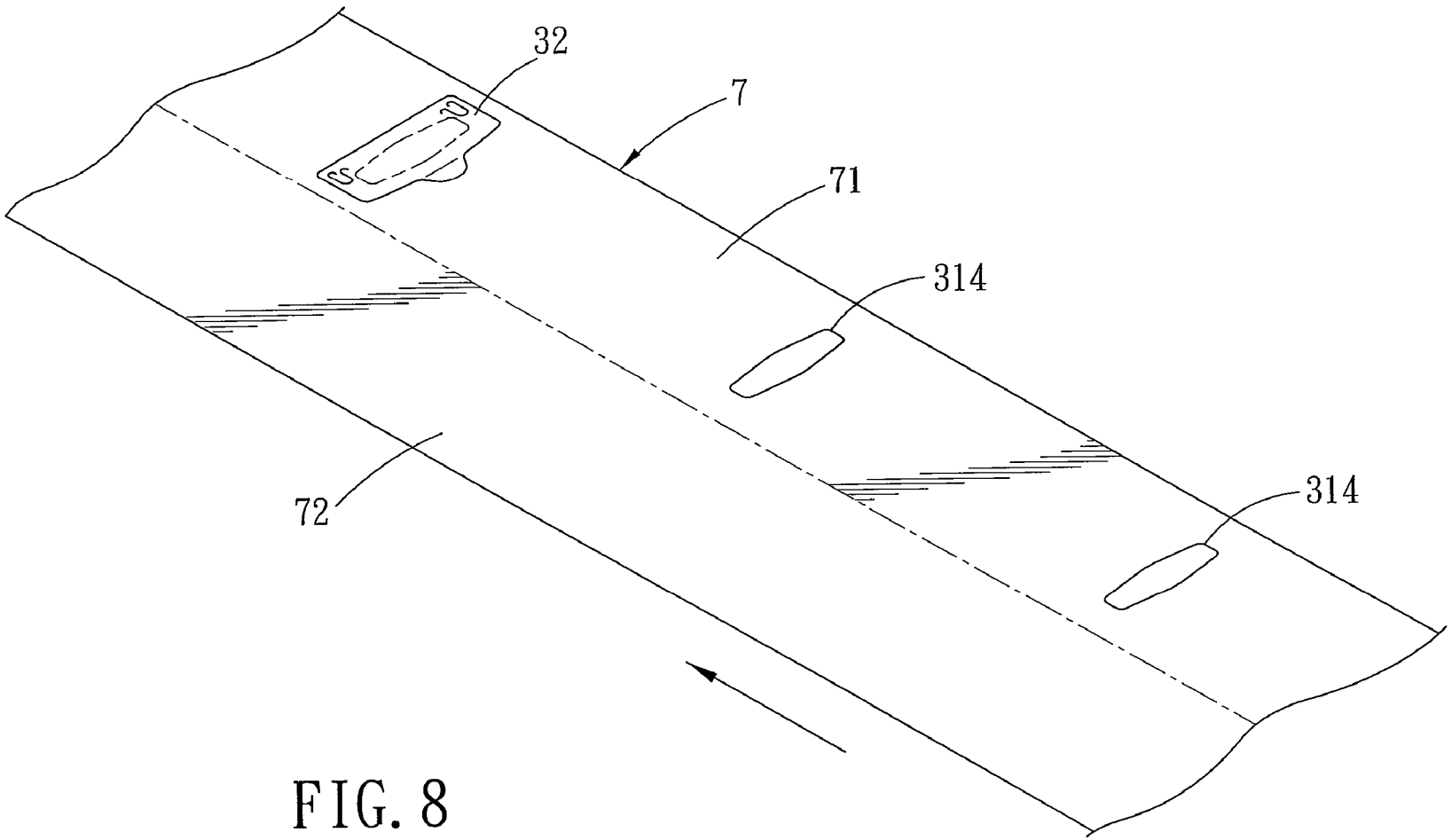
FIG. 8 is a schematic view illustrating a step of forming a plurality of openings in an enveloping material and a step of attaching adhesively a closure sheet to close one of the openings according to the second preferred embodiment of the present invention.

In step 701, an enveloping material 7 includes a single sheet that has first and second halves 71 and 72 and is advanced continuously by orienting the first and second halves 71 and 72 along an advancing direction (i.e., an arrow shown in FIG. 8). The single sheet of the enveloping material 7 of the second preferred embodiment is twice wider than the first sheet 4 of the first preferred embodiment. Step 702 is similar to step 402 but the openings 314 are formed in the first half 71 of the enveloping material 7. Step 703 is the same as step 403, and thus, the description thereof is omitted.

Figure 9:
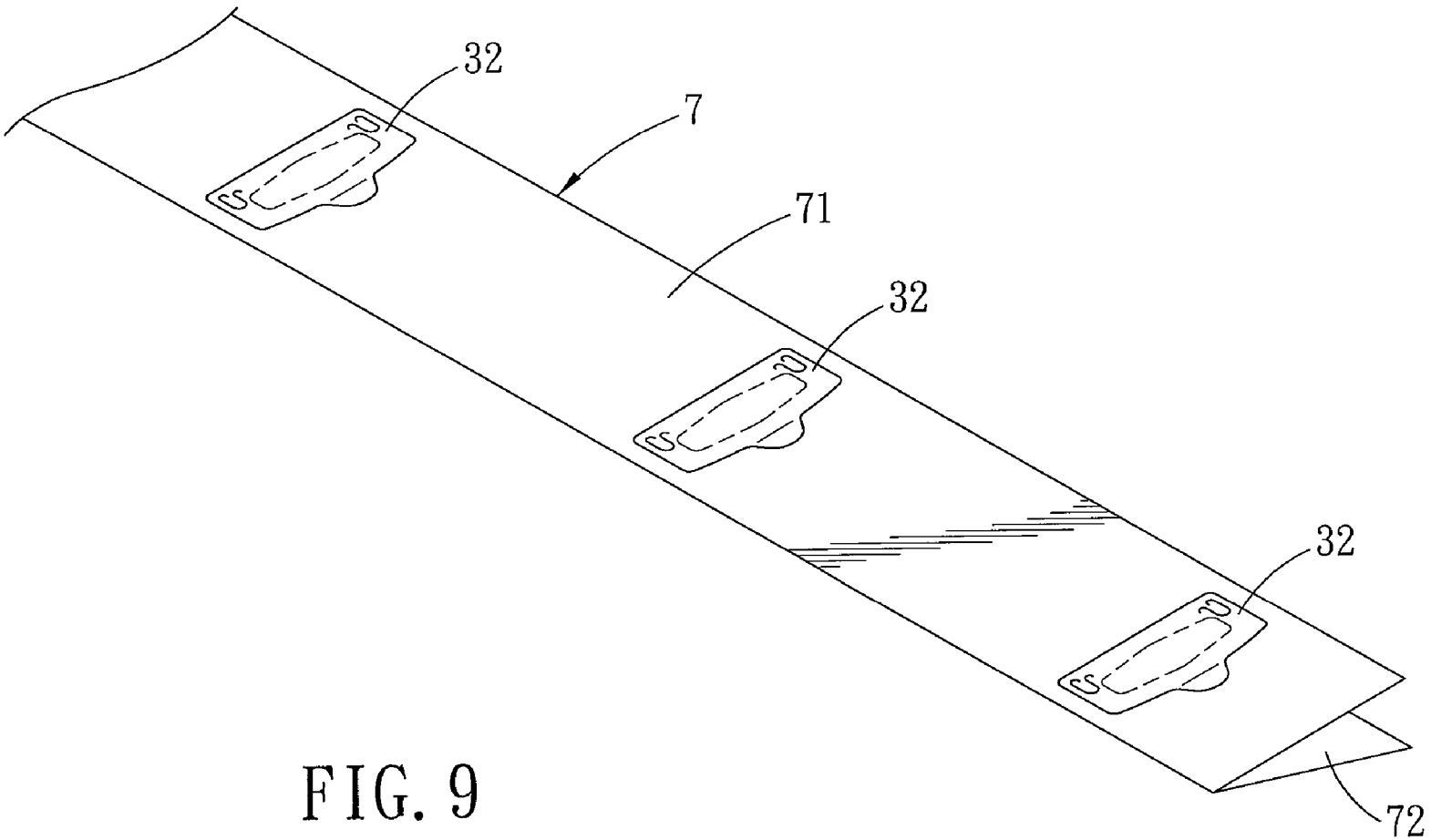
FIG. 9 is a schematic view illustrating a step of folding the enveloping material shown in FIG. 8 in half according to the second embodiment of the present invention.

In step 704, the second half 72 is folded relative to the first half 71 so that the closure sheets 32 are exposed, as shown in FIG. 9.

Step 705 is similar to step 405, but the face mask stacks 20 in the second preferred embodiment are disposed between the first and second halves 71 and 72. Steps 706 and 707 are similar to steps 406 and 407, but the first and second halves 71 and 72 are heat-sealed and then cut at intervals to form the envelopes 3 having one of the face mask stacks 20 therein.

According to this invention, by virtue of use of a closure sheet 32 to close openably the opening 314, the face masks 2 received in the face mask combination 1 can be easily taken out and the face masks 2 left in the face mask combination 1 can be prevented from being contaminated by the outside environment. In addition, since manual operations including loading of the face masks 2 in each envelope 3 and sealing of each envelope 3 can be completely replaced with mechanical operations, the automatic packaging method for face masks of this invention is labor saving and has a relatively high production capacity.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A face mask combination, comprising:

an envelope having two interconnected sheet layers that confine a space therebetween, an opening formed in one of said sheet layers, and a closure sheet closing openably said opening and attached adhesively and releasably to said one of said sheet layers; and at least one face mask disposed in said space and having two opposite ends, one of said opposite ends being disposed in proximity to said opening so as to be exposed from said opening when said closure sheet is opened.

2. The face mask wrappage of claim 1, wherein said face mask is flat and has two ear loops disposed respectively at said opposite ends.

3. An automatic packaging method for face masks, comprising:

advancing continuously an enveloping material;

forming a plurality of openings at intervals in the enveloping material;

attaching adhesively a plurality of closure sheets to the enveloping material with each of the closure sheets closing one of the openings;

placing the face masks on the enveloping material at intervals and aligning one end of each of the face masks with one of the openings; and forming the enveloping material into a plurality of envelopes so that each of the envelopes encloses at least one of the face masks.

4. The automatic packaging method of claim 3, wherein the opening is large enough for passage of at least one of the face masks.

5. The automatic packaging method of claim 3, wherein:

the enveloping material includes first and second sheets;

the openings are formed in the first sheet;

the enveloping material is advanced by arranging the first and second sheets one above the other, and advancing the first and second sheets simultaneously;

the face masks are placed between the first and second sheets; and the forming of the enveloping material includes the steps of heat-sealing the first sheet to the second sheet, and cutting the first and second sheets at intervals.

6. The automatic packaging method of claim 3, wherein:

the enveloping material includes a single sheet that has first and second halves;

the enveloping material is advanced by orienting the first and second halves along an advancing direction;

the openings are formed in the first half;

the forming of the enveloping material includes the steps of folding the second half relative to the first half, heat-sealing the first half to the second half, and cutting the first and second halves at intervals; and the face masks are placed between the first and second halves before the step of heat-sealing.

* * * * *